US006691385B2

(12) United States Patent
Bell et al.

(10) Patent No.: US 6,691,385 B2
(45) Date of Patent: Feb. 17, 2004

(54) PERSONALIZED CASKET CORNER PIECE DISPLAY PEDESTAL

(75) Inventors: Jan Bell, Batesville, IN (US); David Todd Bowers, Batesville, IN (US); Anthony Casablanca, Batesville, IN (US); William Anthony Colson, Hebron, KY (US); Michael L. DiBease, Batesville, IN (US)

(73) Assignee: Batesville Services, Inc., Batesville, IN (US)

( * ) Notice: Subject to any disclaimer, the term of this patent is extended or adjusted under 35 U.S.C. 154(b) by 0 days.

(21) Appl. No.: 10/039,564

(22) Filed: Oct. 22, 2001

(65) Prior Publication Data

US 2002/0148084 A1 Oct. 17, 2002

Related U.S. Application Data

(63) Continuation of application No. 09/377,662, filed on Aug. 19, 1999, now abandoned, which is a continuation-in-part of application No. 29/107,704, filed on Jul. 12, 1999, now Pat. No. Des. 433,585.

(51) Int. Cl.[7] ..... A61G 17/00

(52) U.S. Cl. ..... 27/10; 27/1; 428/913.3; 40/124.5

(58) Field of Search ..... 27/10, 1, 2; D99/13, D99/5, 19; 40/124.5, 722–725, 727; 312/234; 428/913.3; 220/916

(56) References Cited

U.S. PATENT DOCUMENTS

| | | | | |
|---|---|---|---|---|
| 3,025,624 | A | | 3/1962 | Harrell |
| 3,167,844 | A | | 2/1965 | Bachofner |
| D263,534 | S | | 3/1982 | Markus |
| 4,324,026 | A | | 4/1982 | Craft |
| D264,659 | S | | 6/1982 | Markus |
| 5,230,127 | A | | 7/1993 | Zukowski et al. |
| D350,010 | S | | 8/1994 | May et al. |
| D360,731 | S | * | 7/1995 | Graham ..... D99/5 |
| 5,727,291 | A | | 3/1998 | Biondo et al. |
| D398,733 | S | * | 9/1998 | Diviak, Sr. ..... D99/5 |
| 5,832,575 | A | | 11/1998 | Sturino |
| D403,896 | S | | 1/1999 | Bartling et al. |
| 5,896,632 | A | | 4/1999 | Sturino |
| 5,903,961 | A | | 5/1999 | Parker et al. |
| 5,950,288 | A | | 9/1999 | Bach Lahor |
| 6,021,525 | A | * | 2/2000 | Mertins ..... 40/329 |
| 6,167,600 | B1 | | 1/2001 | Williams et al. |

FOREIGN PATENT DOCUMENTS

| | | |
|---|---|---|
| CA | 2242113 | 2/2000 |
| CA | 2279703 | 2/2000 |

* cited by examiner

*Primary Examiner*—William Miller
(74) *Attorney, Agent, or Firm*—Wood, Herron & Evans, LLP

(57) ABSTRACT

A casket corner piece display pedestal and associated methods for memorializing a deceased individual. The casket corner piece display pedestal has a center piece having first and second ends with a casket corner piece receiving surface disposed therebetween. The center piece includes either a memorabilia receiving container, a cremation urn, or both disposed within the first end of the center piece. A base member is attached to the second end of the center piece for supporting the casket corner piece display pedestal. The base member includes an extended portion protruding transversely to the casket corner piece receiving surface on the center piece. A cover member is removably disposed on the first end of the center piece to cover the memorabilia receiving container and/or cremation urn. The cover member includes an extended portion protruding transversely to the casket corner piece receiving surface on the center piece such that the casket corner piece display pedestal has an approximate C-shaped profile. The casket corner piece receiving surface is adapted to receive and hold a casket corner piece so that the casket corner piece can be displayed for viewing.

15 Claims, 3 Drawing Sheets

PERSONALIZED CASKET CORNER PIECE DISPLAY PEDESTAL

RELATED APPLICATIONS

This application is a continuation application of application Ser. No. 09/377,662 filed Aug. 19, 1999, now abandoned, which is a continuation-in-part application of application Serial No. 29/107,704 filed Jul. 12, 1999, now U.S. Pat. No. Design 433,585, which is hereby incorporated by reference herein as if fully set forth in its entirety.

FIELD OF THE INVENTION

The present invention generally relates to apparatus and methods for memorializing a deceased individual and, more specifically, to apparatus and methods for providing the survivors of the deceased a personalized keep sake after the deceased is buried or cremated.

BACKGROUND OF THE INVENTION

When an individual passes away it is customary for the body of the individual to be viewed by family and friends at a funeral home. After the viewing, a memorial service or funeral is generally held at the funeral home or a church to commemorate the life of the deceased. Thereafter, a grave side service may be held with family and friends looking on. With the completion of the grave side service the casket is lowered into the grave where it will remain. A similar service may be held prior to or after the deceased is being cremated. Usually after cremation the cremated remains are collected and presented to the family in a cremation urn.

The casket in which the deceased is displayed and buried can be customized to fit the needs and preferences of the deceased and the family. For instance, a wide variety of materials, finishes, colors and decorative ornamentation can be chosen to meet these needs. The purchaser of a casket can also customize the casket using a variety of stylized trim or corner pieces. These stylized corner pieces usually have standardized decorative elements as chosen by the manufacture. In addition, these corner pieces typically are not personalized. Moreover, these stylized corner pieces are typically permanently mounted onto the casket and are left on the casket when the deceased is buried in the grave site. It is desirable however to more truly personalize the casket to more accurately memorialize the deceased individual.

In addition, once the casket is buried and the funeral services are completed, the families are left with few tangible reminders of the funeral and burial services. Most families receive flowers at the funeral home which pay respect to the deceased and his or her surviving family. These flowers, however, wilt and die after a short time, leaving the family with few remembrances of the funeral or burial services. It is desirable for the families to receive a more tangible and permanent reminder of the funeral or burial services.

In conjunction with offering several different interchangeable trim pieces to customize the casket, a funeral director will often have a display on which the different stylized pieces are mounted for selection by loved ones of the deceased. Often, the corner pieces are simply displayed on a flat board next to one another. The arrangement of the corner pieces on a single display makes it difficult for the family to visualize which trim piece would look best on a particular casket selected by the family. It would be preferable if the individual corner pieces could be displayed in such a manner as to better facilitate a family's matching of them to a particular casket, to provide the customer with a better visual image of what the particular corner piece will look like on the final casket.

SUMMARY OF INVENTION

The invention is generally directed to a casket corner piece display pedestal onto which a personalized casket corner piece may be attached so as to memorialize a deceased. To that end, a casket corner piece display pedestal has a center piece with first and second ends with a casket corner piece receiving surface disposed therebetween. The center piece includes a memorabilia receiving container disposed within the first end of the center piece. A base member is attached to the second end of the center piece for supporting the casket corner piece display. The base member includes an extended portion protruding transversely to the casket corner piece receiving surface on the center piece. A cover member is removably disposed on the first end of the center piece to cover the memorabilia receiving container. The memorabilia receiving container is suitable for holding small mementos or keepsakes that will help to memorialize the deceased. The cover member includes an extended portion protruding transversely to the casket corner piece receiving surface on the center piece such that the casket corner piece display pedestal has an approximate C-shaped profile. The casket corner piece receiving surface is adapted to receive and hold a casket corner piece so that the casket corner piece can be displayed for viewing.

In one embodiment of the invention, the casket corner piece display pedestal further includes a casket corner piece affixed to the casket corner piece receiving surface. To further memorialize the deceased individual, the casket corner piece has personalized graphics emblazoned thereon.

In another aspect of the invention, a cremation urn is disposed within the first end of the center piece in place of the memorabilia receiving container. As such, the cremated remains of a deceased individual may be stored within the center piece of the casket corner piece display pedestal.

In still a further aspect of the invention, the center piece may contain two separate chambers. Accordingly, the first chamber may serve as a memorabilia receiving container and the second chamber may serve as a cremation urn.

The invention further contemplates a method for memorializing a deceased individual who is to be buried in a casket. First, the deceased individual is displayed in a casket including at least one selectively removable personalized casket corner piece. Next, the personalized casket corner piece is removed from the casket prior to inserting the casket into a grave site. The personalized casket corner piece is then affixed to a casket corner piece display. Finally, the casket corner piece display pedestal having the personalized casket corner piece mounted thereto is presented to the survivors of the deceased so that the deceased can be remembered and memorialized by displaying the personalized casket corner piece.

In another aspect of the invention, a method is provided that memorializes a deceased individual who is cremated. First, a deceased individual is displayed in a casket having at least one selectively removable personalized casket corner piece. The personalized casket corner piece is then removed from the casket. After the individual is cremated, his or her remains are collected. The cremated remains are deposited in the cremation urn in the personalized casket corner piece display pedestal to which the personalized casket corner piece has been affixed. Finally, the casket corner piece display pedestal having the personalized casket corner piece mounted thereto and cremation remains therein is presented to survivors of the deceased so that the deceased can be remembered and memorialized by displaying the personalized casket corner piece.

Another aspect of the invention contemplates a method for merchandising casket corner or trim pieces. To that end, a plurality of casket corner piece display pedestals are provided. To each of the individual corner piece display pedestals, one casket corner piece is affixed. Finally, the casket corner piece display pedestals are displayed such that one of the casket corner pieces can be visually compared to the other casket corner pieces also on display.

Various additional advantages, objects and features of the invention will become more readily apparent to those of ordinary skill in the art upon consideration of the following detailed description of the presently preferred embodiment taken in conjunction with the accompanying drawings.

DETAILED DESCRIPTION OF DRAWINGS

DETAILED DESCRIPTION OF PREFERRED EMBODIMENTS

Figure 1:
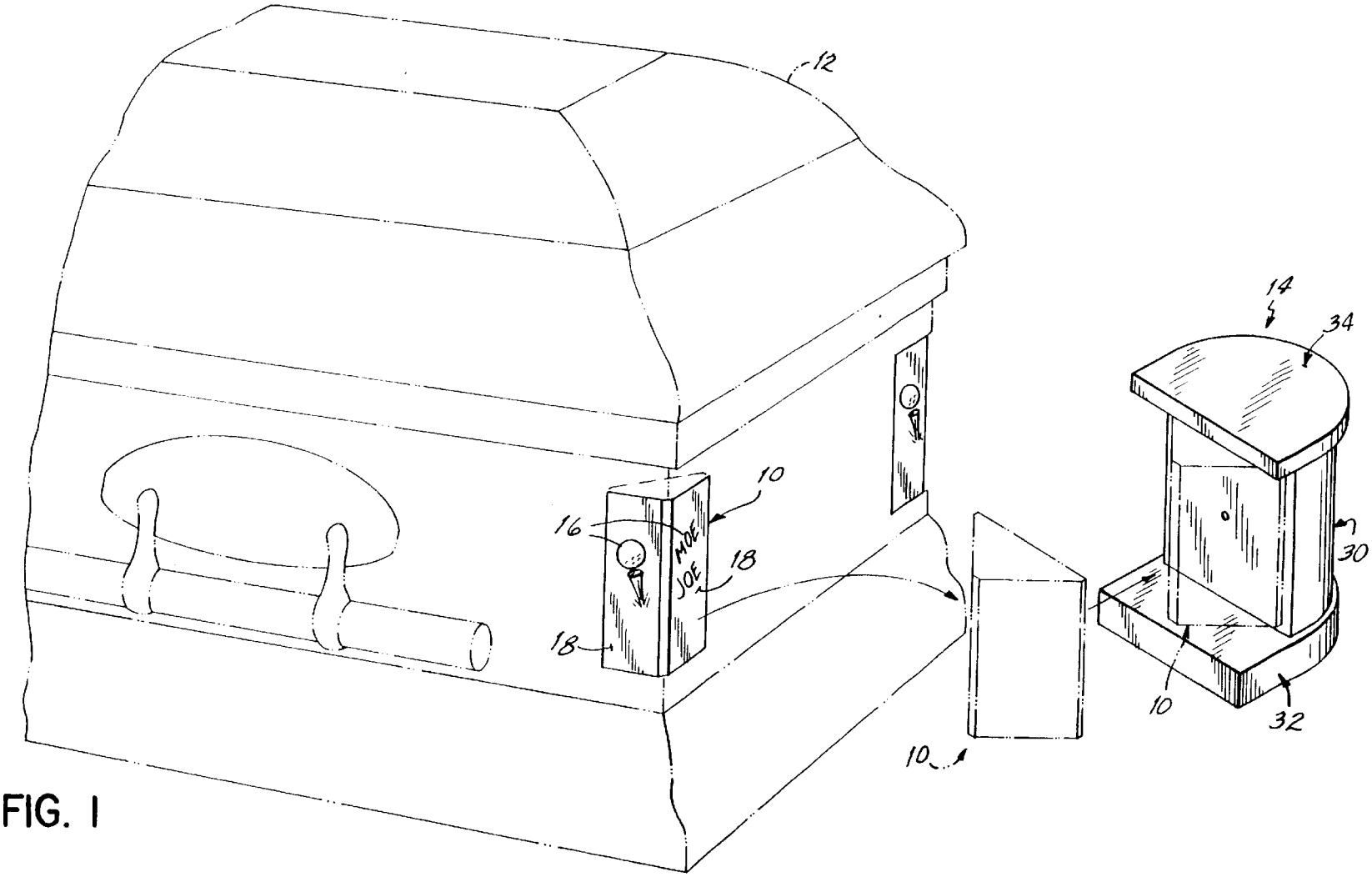
FIG. 1 is a partial perspective view of a personalized casket corner piece attached to a casket and which is removable for placement onto a casket corner display pedestal.

Referring first to FIG. 1, a casket corner piece 10 is shown attached to the corner of a burial container or casket 12 (shown in phantom). The casket corner piece 10 is selectively removable from the corner of the casket 12. Upon removing the casket corner piece 10 from the casket 12, the casket corner piece is affixed to a casket corner piece display pedestal 14 like the one shown in FIG. 1 constructed in accordance with the principles of the invention.

As shown in FIG. 1, the casket corner piece 10 may preferably include personalized graphics 16 such as pictures, names, dates, and the like emblazoned onto the exterior surfaces 18 of the casket corner piece 10. These personalized graphics 16 are intended to help memorialize the deceased by reminding those who see the casket corner piece 10 of a particular aspect of the deceased's life. For instance, the placement of golf related items on the casket corner piece 10 would be suitable personalized graphics 16 for a deceased who was an avid golfer.

Figure 2:
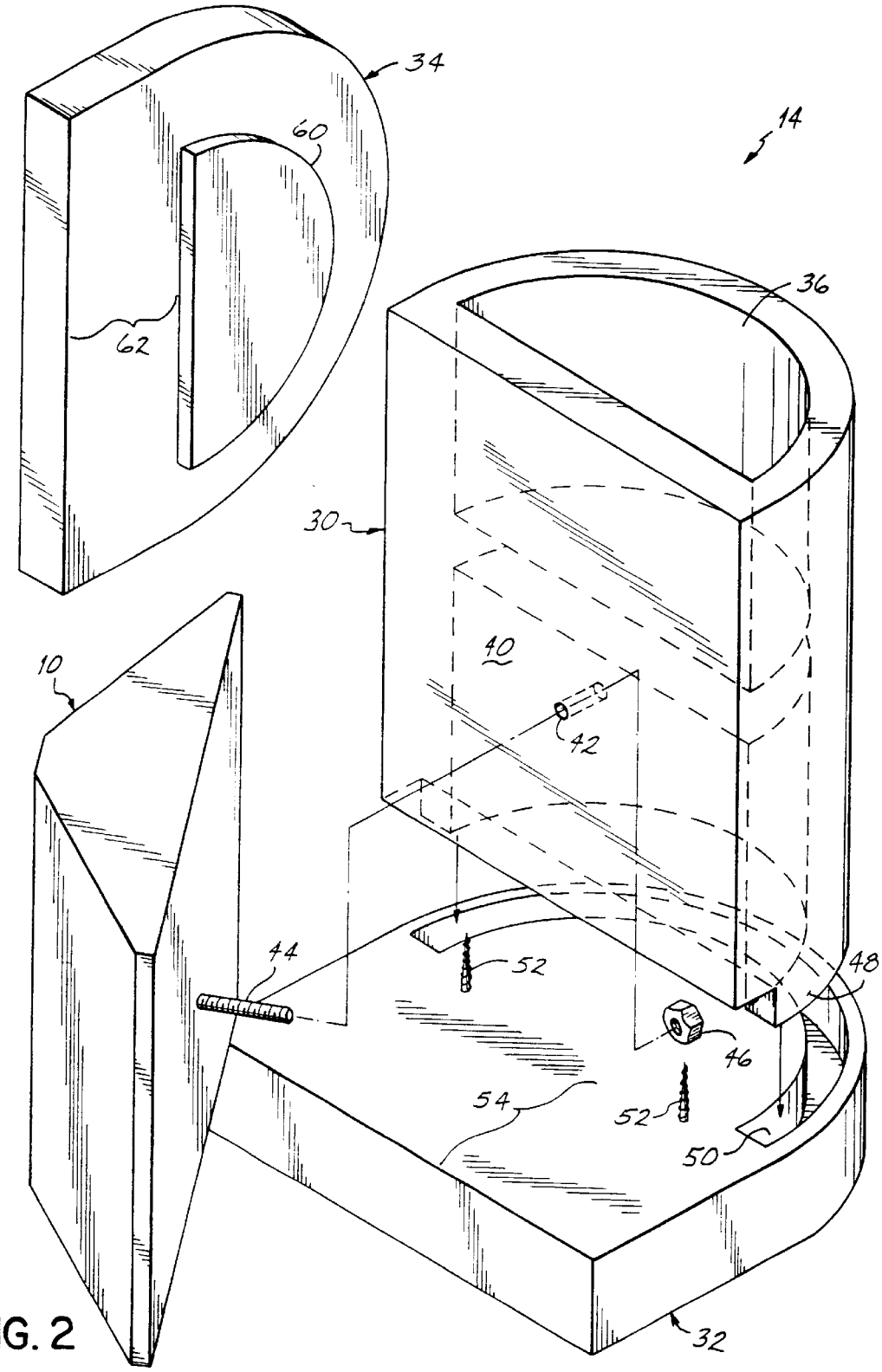
FIG. 2 is a disassembled perspective view of one embodiment of the casket corner display pedestal adapted to receive a personalized casket corner piece.

With reference now to FIG. 2, the casket corner piece display pedestal 14 is constructed of a center piece 30, a base member 32, and a cover member 34. The center piece 30 has an interior chamber 36 located at one end of the center piece 30. The interior chamber 36 can be configured to serve as a memorabilia receiving container suitable for holding mementos or keepsakes of the deceased individual, e.g. golf ball, golf tees, etc. The interior chamber 36 can also be configured to serve as a cremation remains container or cremation urn suitable for holding the cremated remains portion thereof of a cremated deceased.

The center piece 30 also includes a casket corner piece receiving surface 40 which is adapted to receive and have removably secured thereto a casket corner piece 10. The casket corner piece receiving surface 40 has a throughhole 42 for receiving a threaded stud 44 which protrudes from the casket corner piece 10. As such, the casket corner piece can be readily attached to the casket corner piece receiving surface 40 by inserting the threaded stud 44 into throughhole 42 and threading a nut 46 onto the threaded stud 44. As can be appreciated, the casket corner piece 10 can be secured to the casket corner piece receiving surface 40 by any other suitable attachment means such as snaps, screws, glue, hooks and/or the like.

The center piece 30 has a contoured skirt 48 extending down from the lower end of the center piece 30. This contoured skirt 48 is inserted into a complimentary-shaped channel 50 located in the base member 32. Accordingly, the base member 32 supports the center piece 30 and the rest of the casket corner piece display pedestal 14. Screws 52 further secure the center piece 30 to the base member 32. The base member 32 includes an extended portion 54 which extends transversely to the casket corner piece receiving surface 40. Depending upon how the casket corner piece 10 is secured to the casket corner piece receiving surface 40, a portion of the bottom surface of the casket corner piece 10 may rest upon the extended portion 54. As such, the extended portion 54 may provide some support to the casket corner piece 10 being displayed in the casket corner piece display pedestal 14.

The cover member 34 has a protruding section 60 which is shaped to sealingly engage the contour of the interior chamber 36. The cover member 34 also has an extended portion 62 which extends transversely to the casket corner piece receiving surface 40 much the same way as does the extended portion 54 of the base member 32. Consequently, with the base member 32 and the cover member 34 secured to the center piece 30, the casket corner piece display pedestal has an approximate C-shaped profile. As such, the casket corner piece 10 is positioned between the extended portions 54, 62 when secured to the casket corner piece receiving surface 40. Center piece 30, base member 32 and cover member 34 are all attractively semi-circular in cross-section.

Figure 3:
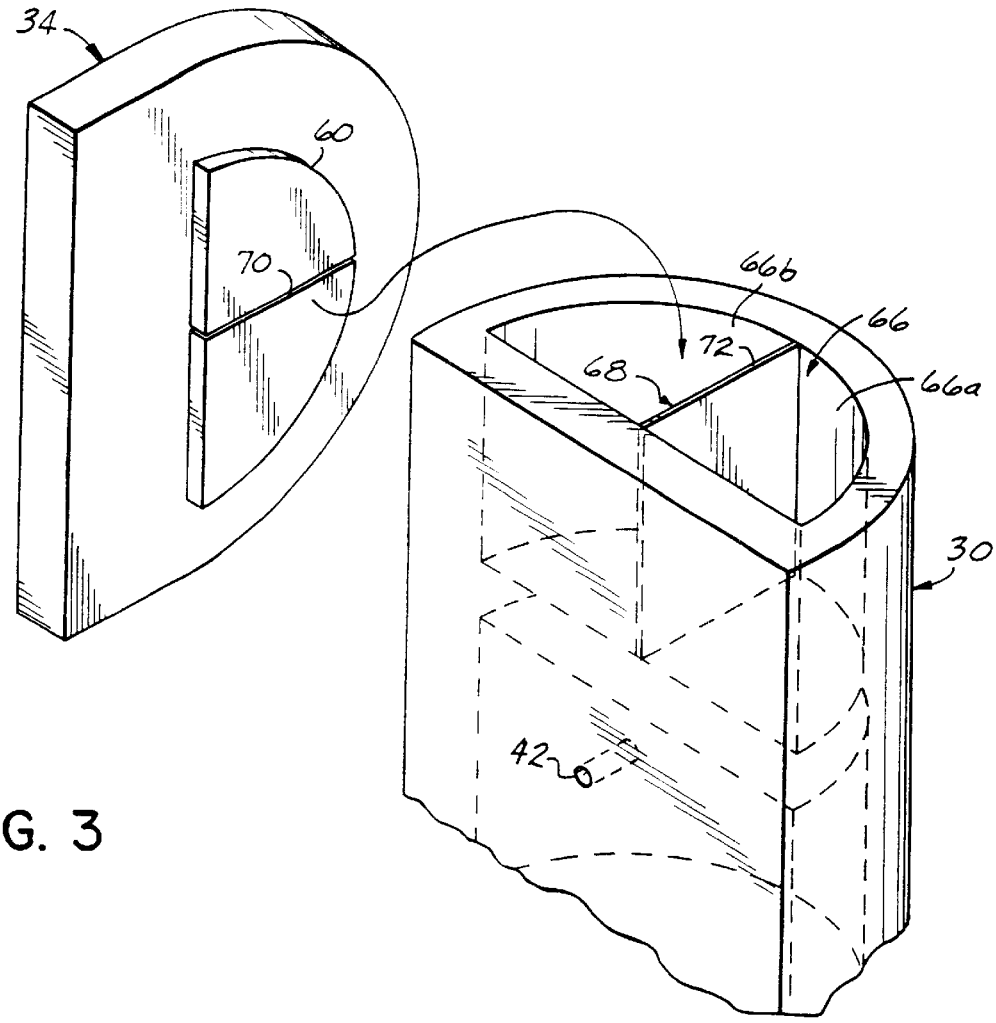
FIG. 3 is a perspective view of the center piece of a second embodiment of the casket corner display pedestal having two interior chambers.

With reference now to FIG. 3, the center piece 30 can have a two-part interior chamber 66 with first and second halves **66*a*, 66*b* separated by a partition member 68. In this configuration the first and second halves 66*a*, 66*b* can serve respectively as a memorabilia receiving container and a cremation remains container or cremation urn. To accommodate the partition member 68, the protruded section 60 of the cover member 34 includes a groove or channel 70 to receive the upper edge 72 of the partition member 68. As such the first and second halves 66*a*, 66*b* are individually covered and sealed by the cover member 34**.

The casket corner piece display pedestal 14 can be made from any suitable structural material. It is contemplated, however, that the casket corner piece display pedestal 14 will be constructed of furniture grade wood that is suitable for receiving various stains and from which are constructed caskets. For example, a variety of woods could be utilized such as mahogany cherry, walnut, maple, and oak. Several display pedestals 14 of various woods and finishes can then be viewed side-by-side to allow a customer to readily visually compare how a corner piece would look on a particular wood casket.

The casket corner piece display pedestal is suited for presenting the family members with the personalized casket corner piece 10 at a grave side service much like a flag presentation ceremony during military funerals. Specifically, before the casket is lowered into the grave, the funeral director would remove the casket corner piece 10 from the corner of the casket 12. The funeral director would then secure the personalized casket corner piece 10 to the casket corner piece display pedestal 14 and present it to the family. Before or after the funeral service, the family can place mementos or keepsakes of the deceased into the interior chamber 36 as a way to memorialize the deceased. The casket corner piece display pedestal 14 can also be similarly used for memorializing a deceased who is cremated as opposed to being buried. The individual to be cremated may still be viewed in a casket at the funeral home. The casket would be adorned by a personalized casket corner piece 10 during such viewing. After cremation, the funeral director would collect the cremated remains and place them within the interior chamber 36 which will serve as a cremation urn. In addition, the funeral director will secure the casket corner piece 10 from the casket in which the deceased was displayed to the casket corner piece display pedestal 14. Thereafter, the funeral director will present the casket corner piece display pedestal 14 to the family members of the cremated individual.

The casket corner piece display pedestal 14 can also be used by a funeral director to display or merchandise the casket corner pieces 10. More specifically, the funeral director can display a variety of different casket corner pieces 10 by removably securing them to individual casket corner piece display pedestals 14 fabricated of the customary casket woods in the funeral home's selection room. By doing so, the customer can readily appreciate what types of corner pieces are available and how the casket corner piece will appear on the finished casket. Displaying the casket corner pieces 10 in this manner is more desirable than merely attaching a plurality of casket corner pieces 10 to a flat board for display in the selection room.

While the present invention has been illustrated by a description of a preferred embodiment and while this embodiment has been described in considerable detail in order to describe the best mode of practicing the invention, it is not the intention of applicant to restrict or in any way limit the scope of the appended claims to such detail. Additional advantages and modifications within the spirit and scope of the invention will readily appear to those skilled in the art.

The invention itself should only be defined by the appended claims, wherein it is claimed:

1. A casket corner piece display, comprising:

a center piece having first and second ends with a casket corner piece receiving surface disposed therebetween, said center piece including a memorabilia compartment disposed within said first end;

a base member attached to said second end of said center piece for supporting the casket corner piece display, said base member including an extended portion protruding transversely to said casket corner piece receiving surface of said center piece; and a cover member removably disposed on said first end of said center piece to cover said memorabilia compartment, said cover member including an extended portion protruding transversely to said casket corner piece receiving surface of said center piece such that the casket corner piece display has an approximate C-shaped profile;

wherein said casket corner piece receiving surface and said base member are adapted to receive and hold a casket corner piece so that the casket corner piece can be displayed for viewing.

2. A casket corner piece display, comprising:

a center piece having first and second ends with a casket corner piece receiving surface disposed therebetween, said center piece including a memorabilia compartment disposed within said first end;

a base member attached to said second end of said center piece for supporting the casket corner piece display, said base member including an extended portion protruding transversely to said casket corner piece receiving surface of said center piece; and a cover member removably disposed on said first end of said center piece to cover said memorabilia compartment, said cover member including an extended portion protruding transversely to said casket corner piece receiving surface of said center piece such that the casket corner piece display has an approximate C-shaped profile;

wherein said casket corner piece receiving surface and said base member are adapted to receive and hold a casket corner piece so that the casket corner piece can be displayed for viewing;

further comprising said casket corner piece affixed to said casket corner piece receiving surface.

3. The casket corner piece display of claim 2, wherein said casket corner piece has personalized graphics emblazoned thereon.

4. A casket corner piece display, comprising:

a center piece having first and second ends with a casket corner piece receiving surface disposed therebetween, said center piece including a cremation remains compartment disposed within said first end, said cremation remains compartment adapted for holding cremation ashes therein;

a base member attached to said second end of said center piece for supporting the casket corner piece display, said base member including an extended portion protruding transversely to said casket corner piece receiving surface of said center piece; and a cover member removably disposed on said first end of said center piece to sealingly engage said cremation remains compartment, said cover member including an extended portion protruding transversely to said casket corner piece receiving surface of said center piece such that the casket corner piece display has an approximate C-shaped profile;

wherein said casket corner piece receiving surface and said base member are adapted to receive and hold a casket corner piece so that the casket corner piece can be displayed for viewing.

5. A casket corner piece display, comprising:

a center piece having first and second ends with a casket corner piece receiving surface disposed therebetween, said center piece including a cremation remains compartment disposed within said first end, said cremation remains compartment adapted for holding cremation ashes therein;

a base member attached to said second end of said center piece for supporting the casket corner piece display, said base member including an extended portion protruding transversely to said casket corner piece receiving surface of said center piece; and a cover member removably disposed on said first end of said center piece to sealingly engage said cremation remains compartment, said cover member including an extended portion protruding transversely to said casket corner piece receiving surface of said center piece such that the casket corner piece display has an approximate C-shaped profile;

wherein said casket corner piece receiving surface and said base member are adapted to receive and hold a casket corner piece so that the casket corner piece can be displayed for viewing;

further comprising said casket corner piece affixed to said casket corner piece receiving surface.

6. The casket corner piece display of claim 5, wherein said casket corner piece has personalized graphics emblazoned thereon.

7. A casket corner piece display, comprising:

a center piece having first and second ends with a casket corner piece receiving surface disposed therebetween, said center piece including first and second chambers disposed within said first end;

a base member attached to said second end of said center piece for supporting the casket corner piece display, said base member including an extended portion protruding transversely to said casket corner piece receiving surface of said center piece; and a cover member removably disposed on said first end of said center piece to cover said first and second chambers, said cover member including an extended portion protruding transversely to said casket corner piece receiving surface of said center piece such that the casket corner piece display has an approximate C-shaped profile;

wherein said casket corner piece receiving surface and said base member are adapted to receive and hold a casket corner piece so that the casket corner piece can be displayed for viewing.

8. The casket corner piece display of claim 7, wherein said first chamber is a memorabilia receiving container and said second chamber is a cremation remains container.

9. A casket corner piece display, comprising:

a center piece having first and second ends with a casket corner piece receiving surface disposed therebetween, said center piece including first and second chambers disposed within said first end;

a base member attached to said second end of said center piece for supporting the casket corner piece display, said base member including an extended portion protruding transversely to said casket corner piece receiving surface of said center piece; and a cover member removably disposed on said first end of said center piece to cover said first and second chambers, said cover member including an extended portion protruding transversely to said casket corner piece receiving surface of said center piece such that the casket corner piece display has an approximate C-shaped profile;

where in said casket corner piece receiving surface and said base member are adapted to receive and hold a casket corner piece so that the casket corner piece can be displayed for viewing;

further comprising said casket corner piece affixed to said casket corner piece receiving surface.

10. The casket corner piece display of claim 9, wherein said casket corner piece has personalized graphics emblazoned thereon.

11. A casket corner piece display, comprising:

a center piece having first and second ends with a casket corner piece receiving surface disposed therebetween, said center piece including a compartment therein;

a base member attached to said second end of said center piece for supporting the casket corner piece display; and a cover member removably disposed on said first end of said center piece;

wherein said casket corner piece receiving surface and said base member are adapted to have secured thereto a casket corner piece and to display the casket corner piece;

wherein said base member and cover member each include an extended portion protruding transversely to said casket corner piece receiving surface of said center piece such that the casket corner piece display is generally C-shaped in profile.

12. The casket corner piece display of claim 11 wherein said center piece, base member and cover member are semi-circular in cross-section.

13. The casket corner piece display of claim 11 wherein said compartment is a memorabilia compartment.

14. The casket corner piece display of claim 11 wherein said compartment is a cremation remains compartment.

15. The casket corner piece display of claim 11 wherein said compartment is a memorabilia compartment and a cremation remains compartment.

* * * * *